US011293156B2

(12) United States Patent
Williamson

(10) Patent No.: US 11,293,156 B2
(45) Date of Patent: Apr. 5, 2022

(54) PILE WITH GROUND ANCHORING MEMBERS

(71) Applicant: PATENTED FOUNDATIONS PTY LTD, Darra (AU)

(72) Inventor: Justin Williamson, Darra (AU)

(73) Assignee: PATENTED FOUNDATIONS PTY LTD, Darra (AU)

( * ) Notice: Subject to any disclaimer, the term of this patent is extended or adjusted under 35 U.S.C. 154(b) by 0 days.

(21) Appl. No.: 16/635,132

(22) PCT Filed: Sep. 6, 2018

(86) PCT No.: PCT/AU2018/050964
§ 371 (c)(1),
(2) Date: Jan. 29, 2020

(87) PCT Pub. No.: WO2019/051537
PCT Pub. Date: Mar. 21, 2019

(65) Prior Publication Data

US 2021/0087768 A1 Mar. 25, 2021

(30) Foreign Application Priority Data

Sep. 12, 2017 (AU) ..... 2017903696

(51) Int. Cl.
*E02D 5/56* (2006.01)
*E02D 7/22* (2006.01)

(52) U.S. Cl.
CPC *E02D 5/56* (2013.01); *E02D 7/22* (2013.01)

(58) Field of Classification Search
CPC ..... E02D 5/56; E02D 7/22
USPC ..... 405/231–232, 241, 244, 252.1; 52/153–155, 157, 165; 248/156, 530, 248/545; 175/323
See application file for complete search history.

(56) References Cited

U.S. PATENT DOCUMENTS 5,013,191 A 5/1991 Kitanaka
8,845,236 B1 * 9/2014 Dosdourian ..... E02D 5/801 405/259.1
10,508,406 B1 * 12/2019 Childress ..... E02D 3/12

FOREIGN PATENT DOCUMENTS

GB 2137678 A 10/1984
JP S58-173288 A 10/1983
(Continued)

OTHER PUBLICATIONS

Machine Translation, Korean document 10-1700851, 10 pages. (Year: 2017).*
(Continued)

*Primary Examiner* — Sunil Singh
(74) *Attorney, Agent, or Firm* — Schwabe, Williamson & Wyatt, PC

(57) ABSTRACT

A pile is disclosed which includes an elongate member having a longitudinal axis, and an anchoring portion connected to the elongate member. The anchoring portion has a plate and also an arcuate member that is radially spaced from the elongate member. The plate has an arcuate distal edge. The plate is connected to the elongate member at a non-perpendicular angle to the longitudinal axis. The arcuate member is located on the arcuate distal edge of the plate. The plate has a leading portion which includes a lower portion of the arcuate distal edge that extends beyond the arcuate member and engages the earth as the pile is screwed into the ground.

19 Claims, 3 Drawing Sheets

(56) References Cited

FOREIGN PATENT DOCUMENTS

| | | | | |
|---|---|---|---|---|
| JP | 2008-144427 | | * | 6/2006 |
| JP | 2014111883 | A | | 6/2014 |
| JP | 2015-212485 | | * | 11/2015 |
| KR | 20150078382 | | | 7/2015 |
| KR | 10-1700851 | | * | 1/2017 |
| NZ | 581041 | A | | 12/2009 |

OTHER PUBLICATIONS

"Performance of a Group of Helical Screw Anchors in sand using inclined load", Singh et al., 5 pages (Year: 2017).*
Patent Cooperation Treaty: International Search Report and Written Opinion for PCT/AU2018-050964 dated Dec. 21, 2018; 8 pages.

* cited by examiner

PILE WITH GROUND ANCHORING MEMBERS

CROSS-REFERENCE TO RELATED APPLICATION

The present application is a national phase entry under 35 U.S.C. § 371 of International Application No. PCT/AU2018/050964, filed Sep. 6, 2018, which designates the United States of America, which claims priority to AU Application No. 2017903696, filed Sep. 12, 2017, the entire disclosures of each of these applications are hereby incorporated by reference in their entireties and for all purposes.

FIELD OF THE INVENTION

The invention relates to a pile. In particular, the invention relates, but is not limited, to a pile for a ground anchoring system in building foundations.

BACKGROUND

Reference to background art herein is not to be construed as an admission that such art constitutes common general knowledge in Australia or elsewhere.

A common process in a number of industries involves winding piles (e.g. poles) into the ground in order to form a foundation. Piles are often a cost effective form of foundation and, for example, can offer a reduced environmental impact in comparison to other foundations. Other advantages of pile foundations may also include ease of installation and a reduced risk to personnel as, for instance, the foundations are typically screwed in with a machine.

Pile design is based on structural and geotechnical principles. Presently available screw piles and blade piles are not always effective, especially in wet soil or soil which mainly comprises gravel and sand. Such soils tend to be non-cohesive or "loose" having little or insufficient clay to bind the soil together. Wet or loose soil tends to slide off the sides of the blades or screw of a blade pile or screw pile respectively, resulting in a low load bearing capacity of the pile. Further, traditional screw piles and blade piles have also been known to have very low lateral bearing capacity.

It is thought that it would be desirable to provide a pile which overcomes or ameliorates one or more of the disadvantages or problems described above, or which at least provides an alternative to current forms of piles.

SUMMARY OF THE INVENTION

In one form, although not necessarily the only or broadest form, the invention resides in a pile comprising:

an elongate member; and an anchoring portion connected to the elongate member, wherein the anchoring portion has an arcuate member that is radially spaced from the elongate member.

The elongate member may be substantially cylindrical. An outer diameter of the elongate member may include any value, for example, from 50 mm to 100 mm, although no limitation whatsoever is to be inferred from this.

The elongate member may be hollow. A wall thickness of the elongate member may include any value from 2 mm to 10 mm. However, again, this is simply by way of example and no limitation whatsoever is to be inferred from this. The elongate member also need not be hollow, and may be solid.

The elongate member may be in the form of a shaft.

The elongate member may include a connecting portion.

The connecting portion may be located at an end portion (a first end portion) of the elongate member. The connecting portion may be located at an opposite end portion of the elongate member (of the pile or pile section) vis-à-vis the anchoring portion.

The connecting portion may be configured to releasably connect to a machine. The machine may be in the form of a rotary powerhead, auger drive or the like. The connecting portion may also be configured to releasably connect to another pile or pile section.

The connecting portion may also (or alternatively) be configured to connect to a separate member. The separate member may be in the form of an extension member, or an extension pile, or another of the piles.

The anchoring portion may be connected to the surface of the elongate member. The anchoring portion may be directly fixed to the elongate member or to the surface of the elongate member.

The anchoring portion may extend away from the surface of the elongate member.

The anchoring portion may be located at (or generally towards) an end portion (a second end portion) of the elongate member. The anchoring portion may be located at (or generally towards) an opposite end portion vis-à-vis the connecting portion.

The anchoring portion may comprise at least one plate. The anchoring member may comprise two plates. The two plates may be connected to the elongate member at the same but opposite angles (i.e. at angles that are of equal angular extent but opposite direction)—in other words, one plate may be tilted by X degrees one way relative to the elongate member (or the longitudinal axis of the elongate member) and the other may be tilted by the same amount the other way relative to the elongate member (or the longitudinal axis of the elongate member). The plate(s) may be flat/planar. The plate(s) may also be arcuate in shape (i.e. like a partial disc).

The (or each) plate may have an arcuate distal edge. The arcuate distal edge (and all portions thereof) may be substantially equidistant (i.e. a constant distance) from the outer surface of the elongate member.

The (or each) plate may have a leading portion that engages the earth as the pile is screwed into the ground. The leading portion may include a lower portion of the arcuate distal edge which is not connected to or covered by the corresponding arcuate member.

The (or each) arcuate member may extend from the arcuate distal edge of the corresponding plate in a direction parallel to the elongate member (or parallel to the longitudinal axis).

The (or each) arcuate member may extend concentrically with the elongate member about the longitudinal axis.

The (or each) arcuate member may be attached to the arcuate distal edge of the (or each) plate along an intersection arc on an inner surface of the arcuate member. The intersection arc may extend transversely and substantially along the center of the inner surface.

The (or each) arcuate member may extend only partially (and not all the way) along the arcuate distal edge of the (or each) plate, leaving the lower portion of the arcuate distal edge on the (or each) plate exposed.

A first arcuate member may be connected to a first plate and a second arcuate member may be connected to a second plate. The first and second arcuate members may be oriented at the same but opposite angles relative to the longitudinal axis of the elongate member (i.e. at angles that are of equal angular extent but opposite direction)—in other words, one arcuate member may be tilted by X degrees one way relative to the elongate member (or the longitudinal axis of the elongate member) and the other may be tilted by the same amount the other way relative to the elongate member (or the longitudinal axis of the elongate member).

The first arcuate member may have an upper (curved) edge and a lower (curved) edge.

The second arcuate member may have an upper (curved) edge and a lower (curved) edge.

The upper (curved) edge of the first arcuate member and the upper (curved) edge of the second arcuate member may lie in a plane (each in a common plane, or a parallel plane, or a differently oriented plane, vis-à-vis the other) that is perpendicular or angled relative to the longitudinal axis of the elongate member.

The lower (curved) edge of the first arcuate member and the lower (curved) edge of the second arcuate member may also lie in a plane (again each in a common plane, or a parallel plane, or a differently oriented plane, vis-à-vis the other) that is perpendicular or angled relative to the longitudinal axis of the elongate member.

The pile may further comprise a second anchoring portion connected to the elongate member.

The second anchoring portion may be the same as, or different to, the first anchoring portion referred to above. The second anchoring portion may comprise two plates. The two plates of the second anchoring portion may be oriented at the same but opposite angles relative to the longitudinal axis of the elongate member. The two plates may be arcuate.

The second anchoring portion may be spaced from the first anchoring portion along the longitudinal axis of the elongate member.

The second anchoring portion may be located nearer to an end of the elongate member (i.e. nearer to the first end of the elongate member) which is opposite to the (second) end having the connecting portion.

The second anchoring portion may be located between the connecting portion and the first anchoring portion. There may also be a third (or even more) anchoring portion(s) connected to the elongate member.

In one particular form, the invention relates to a pile comprising:

an elongate member having a longitudinal axis; and an anchoring portion connected to the elongate member, wherein: the anchoring portion has a plate and also an arcuate member that is radially spaced from the elongate member; the plate has an arcuate distal edge; the plate is connected to the elongate member at a non-perpendicular angle to the longitudinal axis; the arcuate member is located on the arcuate distal edge of the plate; and the plate has a leading portion which includes a lower portion of the arcuate distal edge that extends beyond the arcuate member and engages the earth as the pile is screwed into the ground.

In another form the invention resides in a method for making a pile, the method including the steps of:

connecting an anchoring member to an elongate member or to the surface of the elongate member; and connecting an arcuate member relative to the anchoring member, wherein the arcuate member is radially spaced from the elongate member.

The anchoring member may be an arcuate plate.

The step of connecting the anchoring member to the (surface of the) elongate member may include welding the anchoring member thereto.

The step of connecting the arcuate member relative to the anchoring member may include welding the arcuate member to the anchoring member.

The method may further include connecting a second anchoring portion to the elongate member.

The step of connecting the second anchoring portion to (the surface of) the elongate member may include welding the second anchoring member thereto.

Further features and advantages of the present invention will become apparent from the following detailed description.

BRIEF DESCRIPTION OF THE DRAWINGS

By way of example only, preferred embodiments of the invention will be described more fully hereinafter with reference to the accompanying figures, wherein.

DETAILED DESCRIPTION OF THE DRAWINGS

Figure 1:
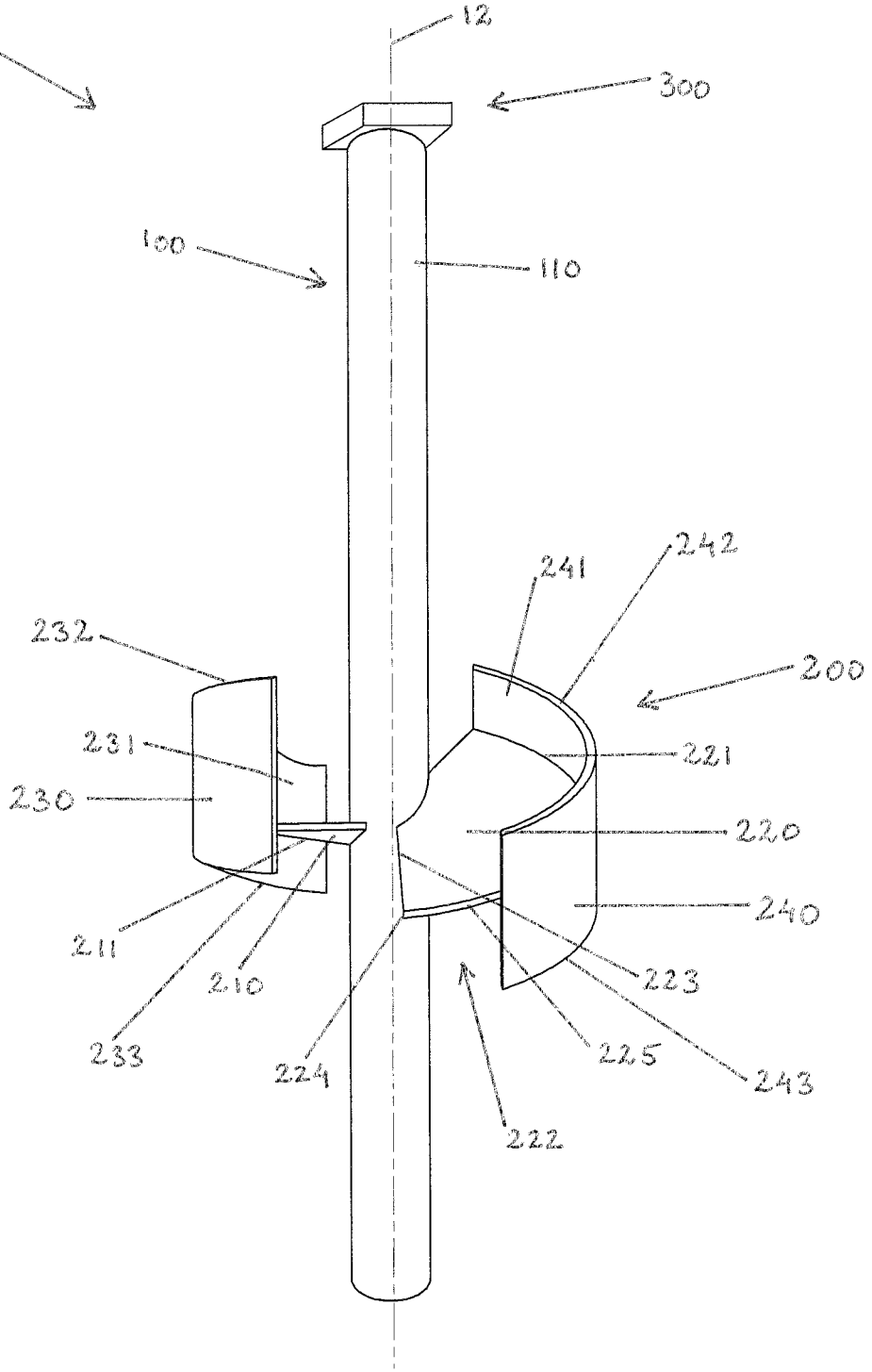
FIG. 1 illustrates a perspective view of a pile, according to an embodiment of the invention.
Figure 2:
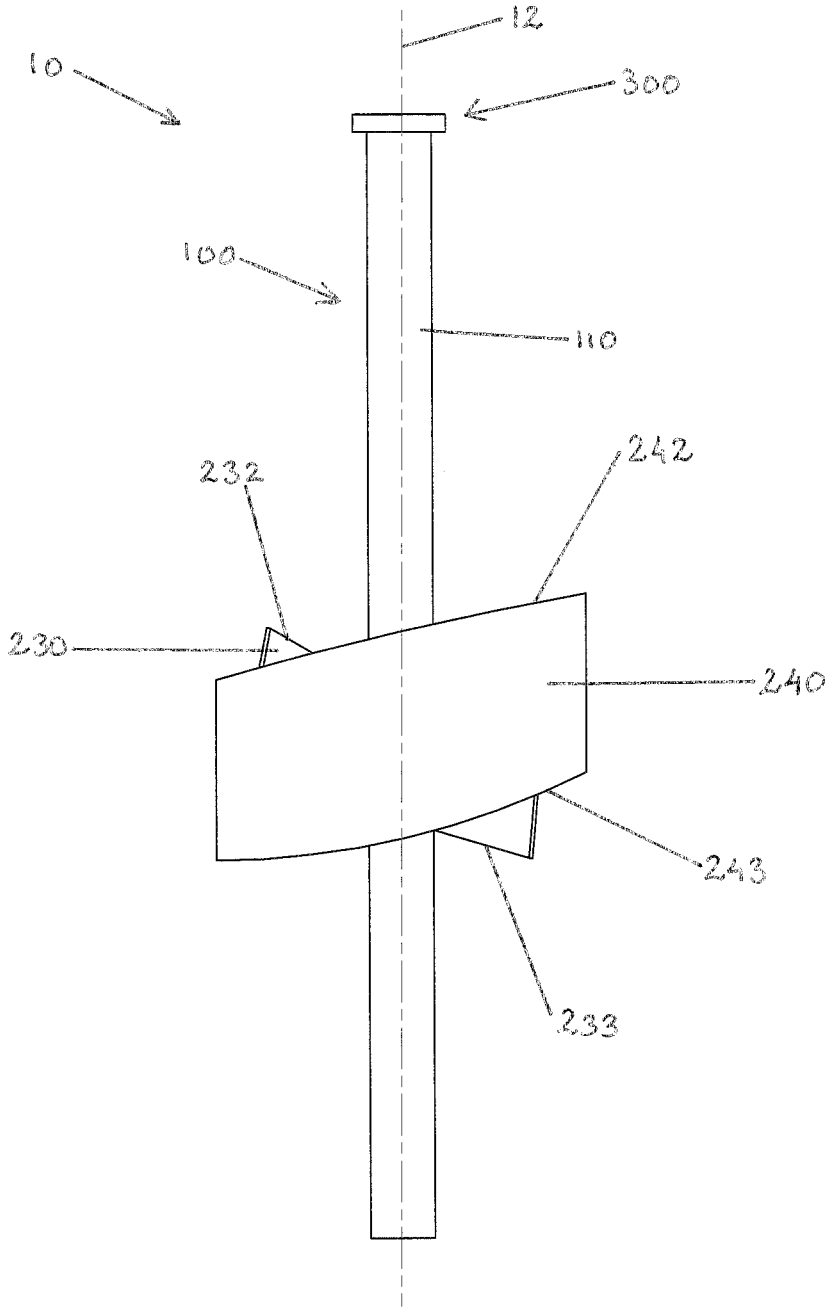
FIG. 2 illustrates a side view of the pile shown in FIG. 1.

FIGS. 1 and 2 illustrate a pile 10, according to an embodiment of the invention. The pile 10 includes an elongate member 100, an anchoring portion 200 and a connecting portion 300. A longitudinal axis 12 extends along the pile 10.

The elongate member 100 is in the form of a hollow round shaft. The elongate member 100 is formed from a metal. The metal in this embodiment is steel. However, in further embodiments the elongate member 100 may be made from different materials including, for example, a composite and/or Aluminium.

The elongate member 100 includes a surface in the form of outer surface 110. The outer surface 110 defines the outer portion of the elongate member 100.

The anchoring portion 200 comprises two flat/planar and arcuate plates 210, 220, each forming a blade. However, in further embodiments the anchoring portion 200 may comprise only one or three or more plates (and in the case of multiple plates these would generally be spaced evenly around the elongate member 100). Moreover, in further embodiments, two or more anchoring portions 200 may be installed at spaced locations along the elongate member 100 to provide additional foundation support. The respective anchoring portions located at different locations along the elongate member need not all necessarily have the same configuration. For example, they need not necessarily have the same number of plates (although they could), or the plates need not necessarily be oriented at the same angle in all anchoring portions (although they could be), etc.

The plates 210, 220 are connected to the outer surface 110 of the elongate member 100, with each blade being connected at the same but opposite angles relative to the longitudinal axis 12 of the elongate member 100. In this embodiment, the plates 210, 220 are welded to the outer surface 110 of the elongate member 100. However, in further embodiments the plates 210, 220 may be integrally formed with the elongate member 100 or e.g. attached to a collar located on the elongated member 100. The plates 210, 220 extend away and radially outward from the elongate member 100.

Each plate 210, 220 has an arcuate distal edge 211, 221 which is substantially equidistant (i.e. a constant distance)

from the outer surface 110 of the elongate member 100, such that each of the distal edges 211, 221 forms an arc with a specific radius about the longitudinal axis 12 of the elongate member 100. However, in further embodiments the shape of the distal edges of the plates 210, 220 may be varied. Like the planar plates 210, 220, the distal edges 211, 221 thereof are oriented at the same but opposite angles relative to the longitudinal axis 12 of the elongate member 100.

Further, each plate 210, 220 has a leading portion 212, 222 which contacts the earth as the anchoring portion 200 (and pile 10) is rotated during insertion of the pile 10 into the ground. The leading portions 212, 222 engage with and break the earth/soil as the pile is screwed into the ground. Each leading portion 212, 222 has a cutting edge 213, 223 which extends radially from the outer surface 110 of the elongate member 100 and is inclined downwardly in a radially outward direction, terminating in a ground engaging point (corner) 214, 224 distal from the outer surface 110 of the elongate member 100. Each leading portion 212, 222 also includes a lower portion 215, 225 of the arcuate distal edges 211, 221. (Note that the leading portion 212, the cutting edge 213, the point (corner) 214 and the lower portion 215 of the arcuate distal edge 211 are not visible in FIG. 1).

An arcuate member 230, 240 extends from each of the distal edges 211, 221 of the plates 210, 220. The arcuate members 230, 240 are radially spaced from the elongate member 100 and extend concentrically with the elongate member 100 about the longitudinal axis 12. The arcuate members 230, 240 are formed from a metal. The metal in this embodiment is steel. However, in further embodiments the arcuate members 230, 240 may be made from different materials including, for example, a composite and/or Aluminium.

The arcuate members 230, 240 are in the form of curved but otherwise rectangular or parallelogram shaped plates. The arcuate members 230, 240 are attached to the distal edges 211, 221 of the plates 210, 220 along an inner surface 231, 241 of the arcuate members 230, 240, such that the arcuate members 230, 240 extend generally perpendicularly to the plates 210, 220. In particular, the arcuate members 230, 240 are attached to the distal edges 211, 221 of the plates 210, 220 along an intersection arc on the inner surfaces 231, 241 which extends transversely and substantially along the center of the inner surfaces 231, 241, i.e. the intersection arcs are equidistant from an upper edge 232, 242 and lower edge 233, 243 of the arcuate members 230, 240. As a result, the arcuate members 230, 240 are oriented at the same but opposite angles relative to the longitudinal axis 12 of the elongate member 100, similar to the plates 210, 220. However, in further embodiments, the arcuate members 230, 240 may be oriented at other angles to the longitudinal axis 12 of the elongate member 100 (see FIG. 3).

In this embodiment (FIGS. 1 and 2), the arcuate members 230, 240 extend only partially along the distal edges 211, 221 of the plates 210, 220, leaving the lower portions 215, 225 of the distal edges 211, 221 exposed. However, in further embodiments the arcuate members 230, 240 may extend substantially along the entire length of the distal edges 211, 221 of the plates 210, 220.

In this embodiment, the arcuate members 230, 240 are welded to the distal edges 211, 221 of the plates 210, 220. However, in further embodiments the arcuate members 230, 240 and the plates 210, 220 may be integrally formed.

The connecting portion 300 includes a coupling that is configured to connect to parts thereabove. The connecting portion 300 can be used to connect the pile 10 to a rotary power head (or auger drive or the like) or to other piles to create a single extended pile comprising a number of distinct piles (or pile segments) connected to each other. The connecting portion 300 may be as described in Australian Patent No. 2013245456.

In order to produce the pile 10, a pair of flat/planar and arcuate plates 210, 220 (i.e. each of the plates is shaped like a partial disc and these) are attached to a cylindrical hollow elongate member 100 at the same but opposite angles. Typically, the plates 210, 220 are welded to the elongate member 100. However, in further embodiments, the plates 210, 220 may be releasably fastened to the elongate member 100.

Following the above, the arcuate members 230, 240 are connected to their respective plates 210, 220. Typically, the arcuate members 230, 240 are welded to the distal edges 211, 221 of the plates 210, 220. However, in further embodiments, the arcuate members 230, 240 may be releasably fastened to the plates 210, 220.

Figure 3:
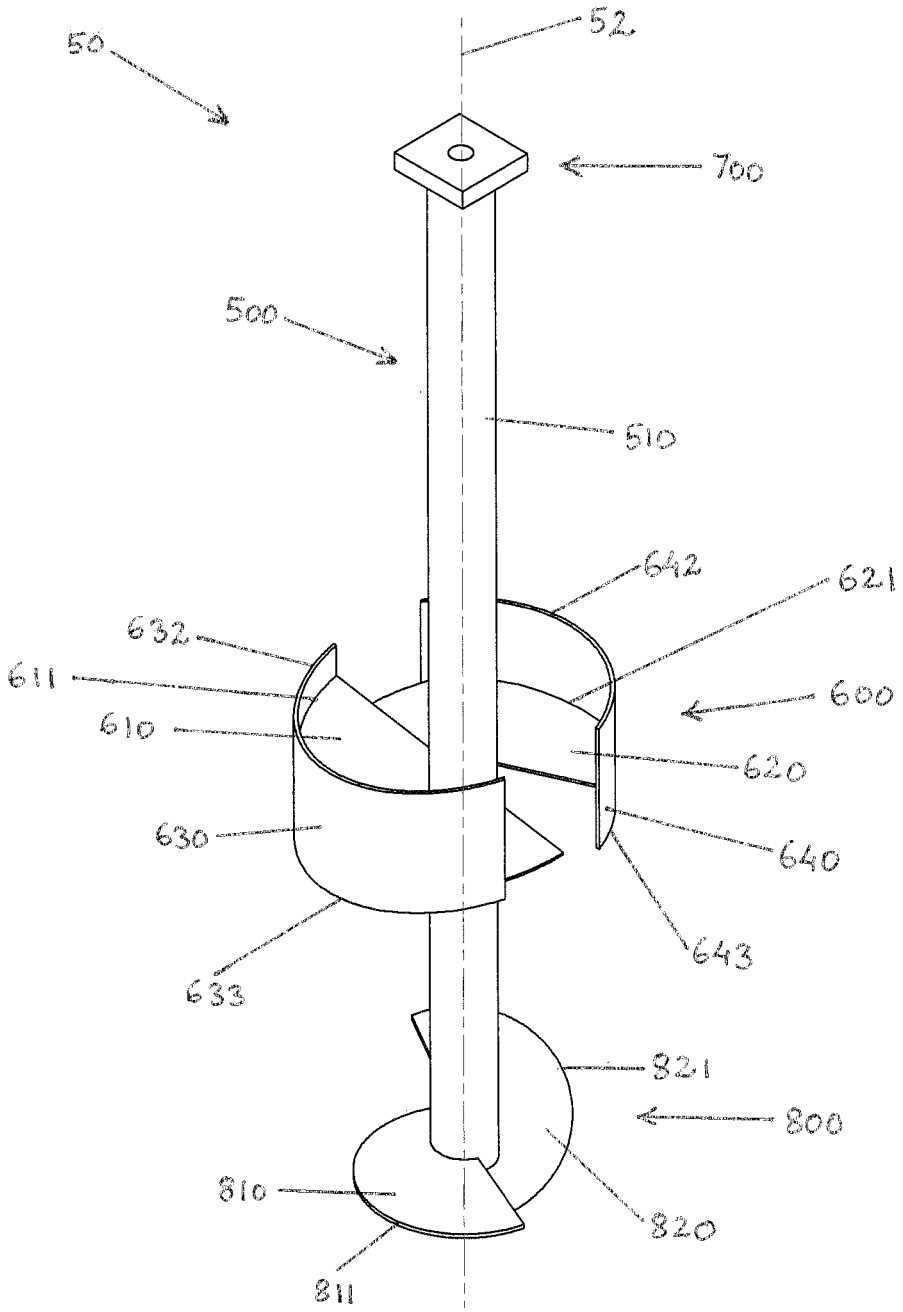
FIG. 3 illustrates a perspective view of a pile, according to a further embodiment of the invention.

FIG. 3 illustrates a screw pile 50, according to a further embodiment of the invention. The screw pile 50 is similar to the screw pile 10 but differences therebetween are noted below.

Like the screw pile 10, the screw pile 50 includes an elongate member 500, a first anchoring portion 600 (comprising a pair of plates 610, 620 and arcuate members 630, 640) and a connecting portion 700. However, the screw pile 50 further includes a second anchoring portion 800. A longitudinal axis 52 extends along the middle of the screw pile 50. The elongate member 500 is substantially cylindrical and hollow with a surface in the form of outer surface 510. The outer surface 510 defines the outer portion of the elongate member 500.

Unlike the pile 10, the arcuate members 630, 640 of the pile 50 are attached to the distal edges 611, 621 of the plates 610, 620 such that the upper edges 632, 642 of the arcuate members 630, 640 lie in a first common plane and lower edges 633, 643 of the arcuate members 630, 640 lie in a second common plane, both planes being perpendicular to the longitudinal axis 52 of the elongate member 500. Consequently, the arcuate members 630, 640 are attached to the distal edges 611, 621 of the plates 610, 620 along an intersection arc on the inner surfaces 631, 641 of the arcuate members 630, 640 such that the intersection arc extends transversely and somewhat diagonally along the inner surfaces 631, 641.

The second anchoring portion 800 comprises two flat/planar and arcuate discs or plates 810, 820. However, in further embodiments the second anchoring portion 800 may comprise only one or three or more discs or plates. Moreover, in further embodiments, two or more anchoring portions 800 (and/or further anchoring portions like 600 and/or further anchoring portions like 200) may be placed along the elongate member 500 to provide additional foundation support. The second anchoring portion 800 is spaced from the first anchoring portion 600 along the longitudinal axis 52 of the elongate member 500.

The plates 810, 820 are connected to the outer surface 510 of the elongate member 500, with each blade being connected at the same but opposite angles relative to the longitudinal axis 52 of the elongate member 500. That is, in this embodiment, the plates 810, 820 are welded to the outer surface 510 of the elongate member 500. However, in further embodiments the plates 810, 820 may be integrally formed with the elongate member 500 or attached to a rotatable collar located on the elongated member 500. The plates 810, 820 extend away and radially outward from the elongate member 500.

Each plate 810, 820 may have an arcuate distal edge 811, 821 which is substantially equidistant from the outer surface 510 of the elongate member 500, such that each of the distal edges 811, 821 forms an arc with a specific radius about the longitudinal axis 52 of the elongate member 500. Alternatively, the shape of the distal edges of the plates 810, 820 may be varied. For example, as shown in FIG. 3, each of the plates may have a radius which is smallest at the lowermost portion of the plate (i.e. at the portion of the plate which is located furthermost down the pile 50), and the radius of each plate 810, 820 may increase moving along and upward around the distal edge. Hence, the outer distal edges 811, 821 of the respective plates may be closest to the elongate member 500 at the lowermost points on the plates 810,820 and furthest from the elongate member 500 at the uppermost points on the plates 810,820. In such cases, like in FIG. 3, the outer distal edges 811, 821 of the respective plates may be said to be helically expanding in the direction moving around and up the pile, and this may help the plates 810, 820 to perform a cutting operation as the pile is screwed in. Similar to the distal edges 611, 621 of the plates 610, 620 of the first anchoring portion 600, the distal edges 811, 821 of the plates 810, 820 are oriented at the same but opposite angles to the longitudinal axis 52 of the elongate member 500.

In this embodiment, the second anchoring portion 800 is located below the first anchoring portion 600, i.e. the second anchoring portion 800 is located nearer to an end of the elongate member 500 which is opposite to the end containing the connecting portion 700.

In order to produce the pile 50, a pair of arcuate plates 610, 620 are attached to a cylindrical hollow elongate member 500 at the same but opposite angles. A pair of arcuate members 630, 640 are then connected to their respective plates 610, 620.

Following (or before) the above, a pair of arcuate plates 810, 820 are attached to the elongate member 500 at the same but opposite angles. Typically, the plates 810, 820 are welded to the elongate member 500. However, in further embodiments, the plates 810, 820 may be releasably fastened to the elongate member 500.

The piles 10, 50, according to the present invention, may offer certain improvements over presently used piles, for example, screw piles and blade piles. When the piles 10, 50 are installed in the ground, the arcuate members 230, 240, 630, 640 may compress and compact the soil inside the arcuate members, especially adjacent to and under the plates 210, 220, 610, 620, thereby preventing movement of the soil adjacent to the anchoring portions 200, 600. This may significantly increase the load bearing capacity of the piles 10, 50 in both compression and tension, and it may also enable the pile to help dampen (and prevent resonance in) the motion of structures secured by the pile during seismic events. Further, the arcuate members 230, 240, 630, 640 may provide the piles 10, 50 with increased lateral bearing capacity, potentially enabling the piles 10, 50 to better withstand soil liquefaction and lateral forces resulting from soil movement, ground vibrations or earthquakes.

In the embodiments depicted in FIGS. 1 and 2 (the pile 10), and in FIG. 3 (the pile 50), multiple of the piles can be connected end on end to form a longer pile. Each pile or pile section (like 100 in FIGS. 1 and 2 and also 500 and FIG. 3) can have multiple of the anchoring portions (like 200 and 600 and 800) thereon and the different anchoring portions may be of different sizes. Similarly, where pile sections are joined end on the end the anchoring portions on different sections may be different sizes.

In this specification, adjectives such as first and second, left and right, upper and lower, top and bottom, and the like may be used solely to distinguish one element or action from another element or action without necessarily requiring or implying any actual such relationship or order. Where the context permits, reference to an integer or a component or step (or the like) is not to be interpreted as being limited to only one of that integer, component, or step, but rather could be one or more of that integer, component, or step etc.

The above description of various embodiments of the present invention is provided for purposes of description to one of ordinary skill in the related art. It is not intended to be exhaustive or to limit the invention to a single disclosed embodiment. Numerous alternatives and variations to the present invention will be apparent to those skilled in the art of the above teaching. Accordingly, while some alternative embodiments have been discussed specifically, other embodiments will be apparent or relatively easily developed by those of ordinary skill in the art. The invention is intended to embrace all alternatives, modifications, and variations of the present invention that have been discussed herein, and other embodiments that fall within the spirit and scope of the above described invention.

In this specification, the terms 'comprises', 'comprising', 'includes', 'including', or similar terms are intended to mean a non-exclusive inclusion, such that a method, system or apparatus that comprises a list of elements does not include those elements solely, but may well include other elements not listed.

The invention claimed is:

1. A pile comprising:

an elongate member having a longitudinal axis; and a first anchoring portion connected to the elongate member, wherein the first anchoring portion comprises a first planar plate and a second planar plate, each plate being connected to a respective arcuate member that is radially spaced from the elongate member, wherein each plate has an arcuate distal edge and a leading portion which includes a lower portion of the arcuate distal edge that extends beyond the respective arcuate member and engages the earth as the pile is screwed into the ground, wherein the arcuate members are located on the respective arcuate distal edges of the first and second plates, wherein the first and second plates are adjacent to each other and connected to the elongate member at opposite and non-perpendicular angles to the longitudinal axis, wherein the first plate lies in a first plane and the second plate lies in a second plane, and wherein the arcuate members are attached to the respective arcuate distal edges of the first and second plates along respective intersection arcs on respective inner surfaces of the arcuate members.

2. A pile as claimed in claim 1, wherein the elongate member includes a connecting portion.

3. A pile as claimed in claim 2, wherein the connecting portion is located at an end portion of the elongate member.

4. A pile as claimed in claim 3, wherein the connecting portion is located at an opposite end of the elongate member vis-à-vis the first anchoring portion.

5. A pile as claimed in claim 4, wherein the connecting portion is configured to releasably connect to a machine, a rotary powerhead, an auger drive, or to another pile or pile section.

6. A pile as claimed in claim 5, wherein the connecting portion is configured to connect to a separate member, an extension member or an extension pile.

7. A pile as claimed in claim 6, wherein the first and second plates are connected to the elongate member at the same but opposite angles.

8. A pile as claimed in claim 7, wherein the first and second plates are arcuate in shape, with an outer edge forming the arcuate distal edge.

9. A pile as claimed in claim 8, wherein all portions of the arcuate distal edges are equidistant from the outer surface of the elongate member.

10. A pile as claimed in claim 9, wherein each arcuate member extends from the respective arcuate distal edges of the first and second plates in a direction parallel to the elongate member.

11. A pile as claimed in claim 10, wherein the arcuate members extend concentrically with the elongate member about the longitudinal axis.

12. A pile as claimed in claim 11, wherein the intersection arcs extend transversely and along the center of the inner surfaces.

13. A pile as claimed in claim 12, wherein the arcuate members extend only partially along the respective arcuate distal edges of the first and second plates, leaving the lower portions of the arcuate distal edges exposed.

14. A pile as claimed in claim 13, wherein the arcuate members are oriented at the same but opposite angles to the longitudinal axis of the elongate member.

15. A pile as claimed in claim 14, wherein each of the arcuate members has an upper edge and a lower edge, and each of the upper edges of the arcuate members lie in a common plane, wherein the common planes of the upper edges of the arcuate members are perpendicular or angled relative to the longitudinal axis of the elongate member, and each of the lower edges of the arcuate members lie in a common plane, wherein the common planes of the lower edges of the arcuate members are perpendicular or angled relative to the longitudinal axis of the elongate member.

16. A pile as claimed in claim 15, wherein the pile comprises a second anchoring portion connected to the elongate member.

17. A pile as claimed in claim 16, wherein the second anchoring portion is spaced from the first anchoring portion along the longitudinal axis of the elongate member.

18. A pile as claimed in claim 17, wherein the second anchoring portion is located nearer to an end of the elongate member which is opposite to the end having the connecting portion.

19. A pile as claimed in claim 17, wherein the second anchoring portion is located between the connecting portion and the first anchoring portion.

* * * * *